United States Patent [19]

Gisiger

[11] 4,369,533

[45] Jan. 25, 1983

[54] BED FOR SICK PERSON

[76] Inventor: Hermann Gisiger, Nischenweg 3, CH-3013 Bern, Switzerland

[21] Appl. No.: 224,558

[22] PCT Filed: Apr. 3, 1980

[86] PCT No.: PCT/CH80/00042

§ 371 Date: Nov. 25, 1980

§ 102(e) Date: Nov. 25, 1980

[87] PCT Pub. No.: WO80/02109

PCT Pub. Date: Oct. 16, 1980

[30] Foreign Application Priority Data

Apr. 3, 1979 [CH] Switzerland ..... 3063/79

[51] Int. Cl.[3] ..... A61G 7/00

[52] U.S. Cl. ..... 5/61; 5/81 C

[58] Field of Search ..... 5/61, 63, 66, 81 R, 5/81 B, 81 C; 128/33, 57, 70

[56] References Cited

U.S. PATENT DOCUMENTS

| | | | |
|---|---|---|---|
| 1,616,065 | 2/1927 | Rosenquist | 128/70 |
| 2,204,624 | 6/1940 | Rupp | 128/33 |
| 3,810,263 | 5/1974 | Taylor et al. | 5/81 R |
| 3,854,152 | 12/1974 | Chez | 5/81 C |
| 3,947,902 | 4/1976 | Conde et al. | 5/81 R |
| 4,297,753 | 11/1981 | Langren | 5/81 C |

*Primary Examiner*—Roy D. Frazier
*Assistant Examiner*—Michael F. Trettel
*Attorney, Agent, or Firm*—Brady, O'Boyle & Gates

[57] ABSTRACT

A hospital bed in which the mattress is composed of an endless belt placed over several rows of rollers that are disposed in a transverse direction of the bed. The outer edges of the mattress can be raised by displacing a column of rollers upwardly by means of an endless chain placed at the head and foot of the bed. By this means a disabled person can be shifted easily and without pain.

12 Claims, 4 Drawing Figures

BED FOR SICK PERSON

The invention relates to a bed for sick person.

Patients who cannot turn over by themselves must be brought—especially during long-term confinement—several times daily into a different position, i.e., for example, from the supine position into one side position and then again into the other side position. The changing of the patients' positions has heretofore been extremely troublesome and required several nurses; for the patient not only had to be turned but also had to be lifted in each case and then again placed in the middle of the bed. Especially the lifting process could furthermore be very painful for the patient, wherein there was even danger of injury to the patient—for example in case of spinal trouble.

The invention is based on the object of providing a bed for a sick person wherein patients can be subjected to positional changes without effort and in a maximally gentle way.

The mattress, which is moved to and fro on rollers in accordance with the invention, eliminates lifting of the patient when changing his position. The patient is merely turned by the nurse and thereupon (or previously) the mattress is shifted laterally in such a way that the patient again comes to lie in the zone of the middle of the bed. With the preferred embodiment shown and claimed, manual turning of the patient is likewise eliminated, in that the latter can be turned respectively into another position by means of one of the liftable rollers.

Figure 1:
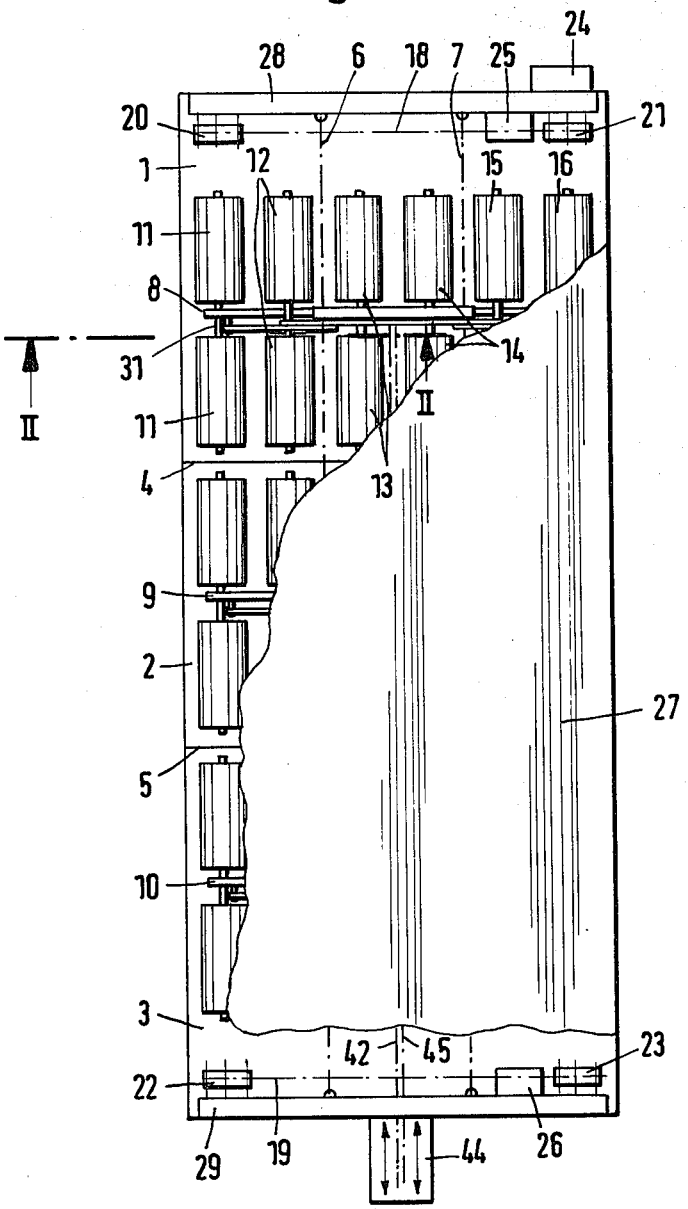
Figure 4:
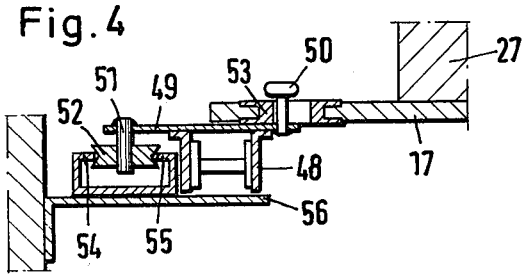
Figure 2:
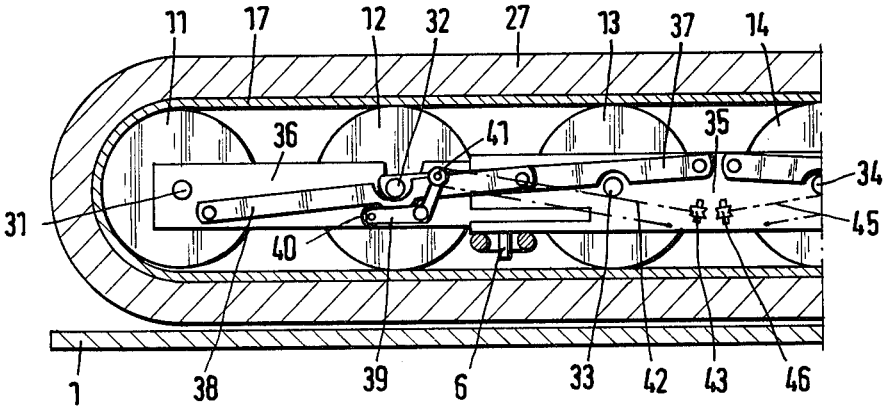
Figure 3:
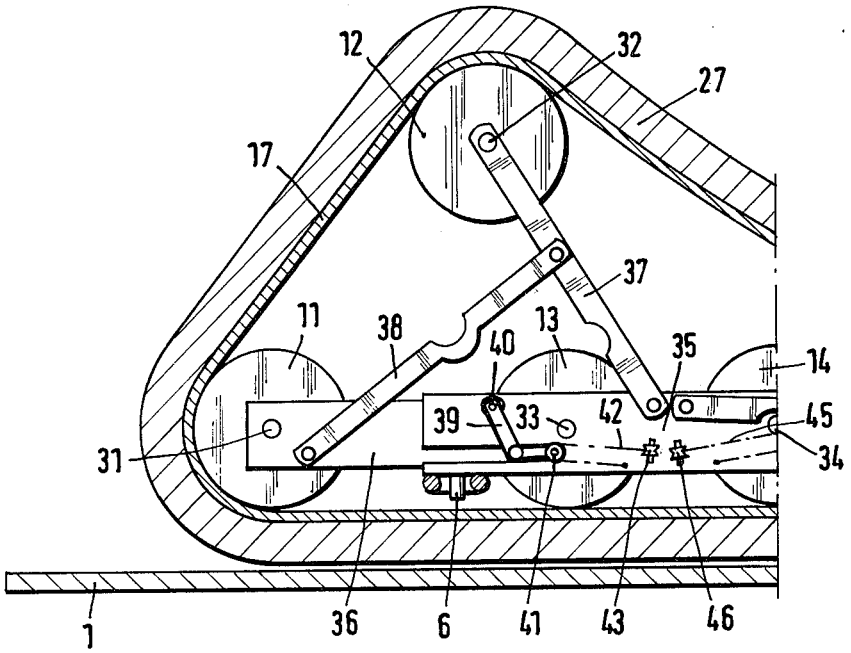

A preferred example of the bed for a sick person according to the invention will be described below in greater detail with reference to the appended drawing wherein:

FIG. 1 shows a schematic top view of a bed for a sick person according to the invention, FIG. 2 shows a cross section through the bed along line II—II in FIG. 1, FIG. 3 shows a cross section corresponding to FIG. 2 wherein the two outermost rollers are in a different position, and FIG. 4 shows a cross section through the upper side of an endless chain schematically illustrated in FIG. 1.

The bed for a sick person illustrated has a conventional bed frame with a head part 1, a central part 2, and a foot part 3, articulated at 4 and 5. (The patient lies with head and torso on the head part, with his posterior and thighs on the central part, and with his lower legs and feet on the foot part.) Two chains 6, 7 are stretched alongside the bed, three traverses 8, 9, 10 being attached to these chains. Each of the traverses 8, 9, 10 carries six pairs of coaxial rollers, which pairs are arranged side by side; the roller pairs carried by the traverse 8 are denoted by 11–16 in the drawing. Thus, six rows of respectively six juxtaposed rollers are arranged at spacings along the bed. An endless belt 17 (FIGS. 2–4) encompasses all rollers and is releasably attached along its two rims to two endless chains 18, 19, the circumferences of these chains corresponding to the periphery of the belt. The chain wheels 20–23 of the chains are arranged in the corners of the head and foot parts 1 and 3, and the drive wheels 21, 23 are drivable synchronously in both directions of rotation by two drive motors 25 and 26 controlled by a combined motor control unit 24. The mattress surrounds the belt 17 as an endless cover 27 and is held in contact with the belt by adhesive friction and along the edges by large-area zippers (not shown) (brand name Velcro fasteners), so that it is entrained by the belt during its travel. The ends of the longitudinal chains 6 and 7 pass through between the upper and lower faces of the endless chain 18 or 19 and are detachably mounted to bars 28, 29 provided at the ends of the head and foot parts 1 and 3. (Arms extending between the chain runs could also project from the bars, the chains could be attached to these arms.)

The roller pairs 11–16 consist of foam material and are supported freely rotatably on axles extending in the longitudinal direction of the bed; in the drawing (FIGS. 2 and 3), merely the axles of pairs 11–14 are denoted, namely by 31–34. The traverse 8 consists of a central section 35 and two outer sections, of which in the drawing (FIGS. 2 and 3) only the left-hand section, denoted by 36, is visible. The central section 35 is attached to the chains 6 and 7 and is fashioned as a rectangular hollow profile wherein the outer sections are displaceably disposed. The axles 33 and 34 of the central roller pairs 13 and 14 are arranged at the central section 35, the axle 31 of the outermost roller pair 11 is arranged at the outer section 36, and the axle 32 of the next-to-outermost roller pair 12 is arranged at the free end of a lever 37 pivotably articulated to the central section 35. A coupling member 38 is articulated with one of its ends approximately in the middle of the lever 37 and with its other end to the end of the outer section 36. An angle lever 39 is pivotably mounted to the outer section 36 and carries on both of its ends respectively one rotatable roller 40, 41. The roller 40 contacts, in the rest position shown in FIG. 2, the underside of the coupling member 38. One end of a pulley line 42 is guided around the roller 41 and attached to the central section 35. The pulley cable 42 is guided by a guide roller 43 into the longitudinal direction of the bed and is extended in FIG. 1 downwardly to a pulling means 44, between the upper and lower runs of the endless chain 19 and through the bar 29. The right-hand portion of the bed, not shown in FIGS. 2 and 3, is fashioned in mirror-image symmetry to the left-hand portion; the corresponding pulley cable is denoted by 45, and its guide roller by 46. The parts described above in connection with the traverse 8 and the roller pairs 11–16 are provided in corresponding fashion in case of traverses 9 and 10 and the roller pairs carried by them. The pulley cables engaging at the left-hand outer parts (the angle levers supported thereat) of the traverses 9 and 10 are operated in the pulling means 44 together with the pulley cable 42; the pulley cables engaging at the right-hand outer parts are operated together with the pulley cable 45. By means of the pulling device 44, the pulley cables of the left-hand side or of the right-hand side can be selectively pulled downwardly in the longitudinal direction, and released again. If the pulley cable 42 is pulled downwardly in FIG. 1 by the pulling means 44, a torque acts in the clockwise direction on the angle lever 39. At the same time, a force acts on the axle of the angle lever 39 and thus on the outer section 36 of the traverse 8, displacing the outer section of the traverse toward the center of the traverse. Thereby the coupling member 38 pushes the lever 37 with the roller pair 12 supported thereat in the upward direction into the position shown in FIG. 3. In this connection, the angle lever 39 serves for lifting the coupling member 38 which, in the rest position, is approximately in alignment with the lever 37. Since during the upward pivoting of the next-to-outermost roller pair 12 the outermost roller pair 11 is shifted toward the inside, the circumference of belt 17 remains constant, i.e. the belt and the mattress are not stretched. Once the pulley cable 42 and the two pulley cables of the left-hand side, pulled together therewith, have been released again, the next-to-outermost roller pairs pivot downwardly again on account of their own weight and due to the pressure exerted thereon by the mattress, the coupling members taking care that the outer traverse sections place the outermost roller pairs back into their rest position toward the outside. The belt 17 is detachably joined to the endless chains 18 and 19 along its two rims. FIG. 4 shows the connection of one belt rim with one chain with the aid of a schematic cross section through the upper chain run: The outer links 48 of the chain are fashioned as angle members; small plates 49 are riveted to the parts of these links bent at an angle at the outer periphery of the chain. On the side facing the bed, each small plate 49 carries a pin 50 projecting outwardly in the revolving plane, each pin 50 exhibiting a head, and on the side facing away from the bed, each small plate 49 carries an inwardly projecting axle 51 on which a guide roller 52 is supported. The rim of the belt 17 is provided with eyes 53 held on the pins 50. The heads of these pins prevent the eyes from sliding off the pins; however, the eyes can be readily pulled off over the heads by hand. The guide roller 52 runs between two guide rails 54, 55 lying in parallel to the revolving plane, whereby the chain is guided so that it is secured against twisting and displacement at right angles to the revolving plane. A twisting and displacement of the chain would otherwise be unavoidable due to the tension exerted by the belt 17. A guide strip 56 between the chain runs, finally, prevents their mutual approach. Instead of the chains 18, 19, it would also be possible to employ toothed belts.

To change the patient's position, who, for example, lies on his back, the two endless chains 18 and 19 are driven, for example, in the counterclockwise direction by means of the motor control means 24. The upper run of the belt 17 and of the mattress 27 then transports the patient in the direction toward the outer roller pairs 11, 12. Thereupon, the drive mechanism is turned off, and the pulley cable 42 as well as the two pulley cables associated therewith on the side of the bed which is the left-hand side in FIG. 1 is operated by means of the pulling device 44. At this stage, the roller pair 12 and the roller pairs arranged therebehind in the axial direction and mounted to the traverses 9 and 10 are pivoted upwardly, the patient thus being turned on his side. The patient then lies in the center of the bed in the lateral position, and the pulleys can be relieved, whereupon the roller pairs return to their rest position. Correspondingly, the patient can be placed into the other side position with the aid of the pulley cable 45 and the two other pulley cables.

If the mattress is to be cleaned, the belt is detached, for example, from the endless chain 18, and the longitudinal chains 6 and 7 are released from the bar 28. The mattress 27 can then be pulled off the belt—after undoing the flat zipper-type closure.

The belt 17 could also constitute the inner surface of the mattress cover 27, i.e. the belt and mattress could be constructed of one piece, but in this case removal of the mattress for cleaning purposes is more cumbersome.

The supporting device consisting of the traverses 8 through 10 and the longitudinal chains 6 and 7 need not bear the entire weight of the rollers, the mattress, and the patient, because the parts 1, 2, 3 of the bed frame form a support for the mattress. The tensile stress of the longitudinal chains 6 and 7, however, must be dimensioned to be so large that the mattress 27 when driven in the revolving direction slides readily over the support 1, 2, 3. Furthermore, the tensile stress must also ensure that the longitudinal chains 6, 7 hold the traverses 8, 9, 10 in their mutual position and, in particular, prevent mutual pivoting of the traverses.

The parts 1, 2, 3 can be readily pivoted with respect to one another (about the pivot axles 4, 5) i.e., for example, the head part 6 can be pivoted upwardly, because the longitudinal chains 6 and 7 are articulate, and the bars 28, 29 holding these chains, as well as the drive unit 18–26 are attached to the head and foot parts 1 and 3, i.e. are pivoted with the latter. However, it is also possible to provide, in place of the longitudinal chains 6 and 7, also other longitudinal elements, for example multipartite rods, the individual members of which are articulated together, wherein the articulated joints would have to be located in the zone of the pivot axles 4, 5.

The pulling means 44 could also be arranged on the underside of the bed, and the two pulley cables 42, 45 could be guided downwardly at the bar 29. Furthermore, the pulling means 44 could be attached to the longitudinal chains 6 and 7 in the space between the row of rollers which is lowermost or uppermost in FIG. 1, the belt 17, and the endless chain 19 or 18, and connecting lines could be extended from this pulling means between the runs of the chain 19 or 18, through such runs, to a control device on the outside of the bed.

The endless belt 17 can consist, for example, of elongation-resistant material having the brand name "Stamoid".

I claim:

1. Bed for sick and disabled persons comprising a plurality of juxtaposed rollers, and endless belt (17) surrounding said plurality of rollers and being movable to and fro in the transverse direction of the bed and a mattress (27) mounted on said endless belt (17), said plurality of rollers including first rollers (11,16), arranged along the longitudinal borders of the bed and second rollers (12,15) arranged between said first rollers (11,16) and the center line of the bed, at least one of said second rollers (12,15) being liftable on both sides of the bed to such a height that the sick person can be turned from the supine position into one side position and said first rollers (11,16) being shiftable in such a way that they (11,16) are shifted perforce, during the lifting and lowering of such second rollers (12, 15), in the direction toward the center line of the bed and back toward the outside.

2. Bed for sick and disabled persons according to claim 1 having a bed frame including a head part (1) swivelling about an articulating axis (4), wherein said plurality of rollers consists of several rows of juxtaposed, freely rotatable rollers (11–16) which latter are supported at mutual spacings along the bed frame by a supporting means (6–10) which has at least two longitudinal members (6,7) stretched alongside the bed frame, said longitudinal members being articulate or flexible at least in the zone of the articulating axis (4) of the heat part (1) of the bed frame; and said endless belt (17), surrounding said several rows of rollers (11–16) being drivable in both revolving directions.

3. Bed for sick and disabled persons according to claim 2, wherein the endless belt (17) is attached along both of its rims to respectively one endless pulling means (18,19) arranged at the head and foot ends (1,3) of the bed frame, these pulling means being drivable synchronously in both revolving directions; and that the tensioning directions of the longitudinal members (6,7) of the supporting means (6-10) extend between the upper and lower runs of the endless pulling means (18,19) through these runs.

4. Bed for sick and disabled persons according to claim 2, wherein the supporting means (6–10) for respectively two successive rows of rollers comprises a traverse (8,9,10) attached to the longitudinal members (6,7) and carrying longitudinal axles (31–34) each supporting a roller pair (11–16); that the axles (32) of the liftable second rollers (12,15) are mounted each on the free end of a lever (37) pivotably articulated to the traverse (8), a first pulley cable (42), a second pulley cable (45), and the levers (37) carrying second roller pairs lying in series on one side of the bed are pivotable upwardly by means of said first pulley cable (42), and the levers carrying second roller pairs lying in series on the other side of the bed are pivotable upwardly by means of said second pulley cable (45).

5. Bed for sick and disabled persons according to claim 4, wherein the axles (31) of the first roller pairs (11,16) are supported to be laterally displaceable at the traverses (8,9,10) in such a way that the first roller pairs (11,16), during pivoting of the second roller pairs (12,15) supported by the levers (37), are shifted in the direction of the traverse (8,9,10) so that the circumference of the endless belt (17) remains constant.

6. Bed for sick and disabled persons according to claim 5, wherein each tranverse (8, 9, 10) consists of a central section (35) attached to the longitudinal members (6,7) of the supporting means (6–10) and two outer sections (36) arranged displaceably at the central section (35) wherein each of the pivotable levers (37) is articulated to the central traverse section (35); that respectively one coupling member (38) is articulated with one of its ends to the pivotable lever (37) and with its other end to the displaceable outer section (36) of the traverse (8); and that the first and second pulley cables (42,45) engage the outer, displaceable traverse sections (36) and are guided (43) at the central sections (35) so that when the pulley cables are pulled, the outer sections (36) of the traverses (8,9,10) are shifted toward the center (35), whereby the coupling members (38) push the pivotable levers (37) in the upward direction.

7. Bed for sick and disabled persons according to claim 3, wherein the pulling means are endless chains (18,19) or toothed belts which are guided so that they are secured (52,54,55) against twisting and displacements at right angles to the revolving plane, connecting elements (50) projecting therefrom, by means of which a detachable connection is established with eyes (53) or counter elements attached to the rims of the endless belt (17).

8. Bed for sick and disabled persons according to claim 7, including two drive motors (25,26), a common control device (24), and the two endless chains (18,19) or toothed belts are drivable synchronously by the two drive motors (25,26) regulated by a common control device (24).

9. Bed for sick and disabled persons according to claim 2, a foot part (3) included in said bed frame, wherein the longitudinal members of the supporting means (6–10) are chains (6,7) attached to the head part and foot part (1,3) of the bed frame, wherein the attachment is releasable at least on one end.

10. Bed for sick and disabled persons according to claim 2, including two rims on the endless belt (17), said mattress fashioned as an endless cover (27), and said endless cover having two cover rims which are joined to the two rims of the endless belt (17) in a releasable fashion.

11. Bed for sick and disabled persons according to claim 1, wherein the first and second rollers 11–16) having jackets which consist of a soft-elastic material.

12. Bed for sick and disabled persons comprising an endless belt (17), and a mattress (27) mounted on said endless belt, movable to and fro in the transverse direction of the bed, lifting means (12,15) surrounded by said endless belt (17), for lifting a part of said belt and, said mattress (27) mounted thereon, said endless belt having end rims, endless pulling means (18,19) connected at the head and foot ends (1,3) of the bed, said endless belt (17) being attached along both of its rims to respectively one of said endless pulling means (18,19), said endless pulling means being drivable synchronously in both revolving directions, and said lifting means (12,15) being arranged between the longitudinal borders of the bed and the center line of the bed and being liftable to such a height that the sick person can be turned from the supine position into one side position.

* * * * *